US005316176A

United States Patent [19]

Genest

[11] Patent Number: 5,316,176

[45] Date of Patent: May 31, 1994

[54] HAIR PROTECTOR SHIELD FOR FOOD SERVICE TRAYS

[76] Inventor: Nelson J. Genest, 14 Fontaine St., Augusta, Me. 04330

[21] Appl. No.: 975,462

[22] Filed: Nov. 12, 1992

[51] Int. Cl.[5] ..... B65D 51/00

[52] U.S. Cl. ..... 220/694; 220/731

[58] Field of Search ..... 220/694, 731, 23.83, 220/23.86

[56] References Cited

U.S. PATENT DOCUMENTS

| | | | |
|---|---|---|---|
| 141,615 | 8/1873 | Wilson | 220/731 |
| 149,298 | 4/1874 | Frink | 220/731 |
| 692,066 | 1/1902 | Nordin | 220/731 X |
| 774,763 | 11/1904 | Levey | 220/23.83 |
| 884,870 | 4/1908 | Sikes | 220/731 |
| 1,644,612 | 10/1927 | Roberts | 220/23.03 |
| 2,501,588 | 3/1950 | Somers | 107/19 |
| 2,598,789 | 6/1952 | Harrell | 220/694 X |
| 2,611,510 | 9/1952 | Willits | 220/85 |
| 2,617,350 | 11/1952 | Shol | 220/694 X |
| 2,664,722 | 1/1954 | Barr | 65/15 |
| 2,891,695 | 6/1959 | Peters | 220/97 |
| 3,065,978 | 11/1962 | Stephens | 220/694 X |
| 3,268,111 | 8/1966 | Duddy | 220/90 |
| 3,999,680 | 12/1976 | Cho | 220/731 X |
| 4,413,745 | 11/1983 | Stroud | 220/23.4 |

FOREIGN PATENT DOCUMENTS

| | | | |
|---|---|---|---|
| 1978 | of 1911 | United Kingdom | 220/731 |

*Primary Examiner*—Steven M. Pollard

[57] ABSTRACT

A free standing hair protector with a vertical shield having an outward curvature that permits the shield to fit adjacent to the outer edge of a standard food service tray. The vertical shield meets the base at a right angle and the outer surface of the right angle edge is a transitional planar surface that is mated to fit the inner transitional shape of the service tray. The base of the hair protector shield is large enough to provide lateral support for the hair protector and also large enough so that one or more dishes can be placed upon it. When in use the outwardly facing vertical shield conforms to the tray's edge and is located between the dishes to be served and the server's head as the food is being transported to the patrons to be served. The shield height extends above the food to be served an amount which protects falling or swishing hair from reaching the food.

9 Claims, 1 Drawing Sheet

HAIR PROTECTOR SHIELD FOR FOOD SERVICE TRAYS

FIELD OF THE INVENTION

The present invention relates to a vertical hair shield that sits atop a food service tray, thereby preventing the servant's hair, hair follicles or other contamination from contaminating food to be served while the tray is being supported on the server's shoulder.

DESCRIPTION OF PRIOR ART

Prior to the advent of this invention, little effort has been made to prevent the contamination of food due to hair, follicles, etc. during the time the food leaves the kitchen to when it is delivered to the patron's table. The focus of such efforts has been on the food preparers, who frequently wear hair nets and caps or the like.

Self-service food stations, such as buffet tables, are often provided with plastic shields mounted above the serving table. Such plastic shields incorporate sloping sides, thereby protecting against contamination of the food due to falling hairs or other contaminants.

It is quite common to see a long-haired food server carrying a food tray at shoulder height to serve patrons of a food establishment. Inadvertently such hair may be swished through or actually end up in the food that is being served. A search of the prior art discloses that a simple and straight forward solution to protecting against such contamination of food to be served has not yet been provided. A solution to this problem, prior to this invention, has not been suggested by any known art.

The prior art of deflection shields is well developed by numerous references. A novelty search of this invention discloses a number of related reference which have some marginal relevance to this invention, and each of those prior art references will now be discussed.

The prior art search includes, for example, U.S. Pat. No. 2,611,510 to H. H. Willits (1952) which discloses an inwardly sloping grease shield that mounts on an upper edge of the rim of an ordinary skillet, thereby preventing grease from splattering onto adjacent objects and surfaces. It does not suggest that it will, in any way, prevent contamination of food within the skillet due to falling hair, follicles etc.

U.S. Pat. No. 149,298 to L. Frink (1874) is similar to the Willits disclosure in that it seeks to prevent the contents of a container from splashing outward. The Frink disclosure differs from Willits, however, in that it is intended to be used in conjunction with an upper rim of a milking bucket, rather than a skillet.

Another similar disclosure is U.S. Pat. No. 884,870 to S. J. Sikes (1908). As was the case with Willits and Frink, Sikes discloses a shield which prevents the contents of a container from splashing outward. The Sikes disclosure differs from Willits and Frink, however, in that it is intended to be used with an improved turpentine bucket.

Although each of the above-noted prior art references utilize shields to prevent the contents of a container from splashing outward, all of them are adapted to seat against a thin upstanding rim. None of these references have a base adaptable to sit on the flat surface of a food service tray with sufficient base area that food to be served sits on the base and helps hold the shield in place.

Moreover, none of these references teach or suggest, preventing hair follicles from contaminating the food carried upon the tray. Nor do any of these prior art references teach or suggest the features of this invention such as a free-standing shield that sits atop a food service tray and acts to prevent hair follicles from falling upon the food and thereby contaminating it.

A prior art disclosure which provides an upwardly extending surface integral with a food service tray is U.S. Pat. No. 2,891,695 to H. W. Peters (1959). The Peters disclosure shows a hospital food service tray that has an upstanding forwardly inclined card-holder 11 that is integrally formed as part of the tray itself. Identification cards are inserted into the tray and display the character of the meal and identification of the person to be served.

The device disclosed by Peters is too small to be suitable for the commercial food service environment, and differs in shape, construction and purpose from the hair protector shield of this invention. Additionally the upstanding card-holder is not of sufficient height to protect against contamination of falling or swirling hair on food to be served by a user carrying same at shoulder height.

Several more prior art references also discuss shields used in conjunction with another device without teaching or suggesting the novel features of this invention for preventing the food contamination due to falling hair into food being carried upon a food service tray. U.S. Pat. No. 3,268,111 to J. J. Duddy (1966) discloses a butter dish with an attached shield which allows for excess butter to be wiped from a knife.

In addition, a U.S. Pat. No. 774,763 to W. H. Levey (1904) discloses an auxiliary pan which can be fitted above a dish pan to receive washed dishes. U.S. Pat. No. 1,644,612 to J. Roberts (1927) discloses a finger bowl that may be attached to plates for the serving of jellies or washing of fingers.

U.S. Pat. No. 2,664,722 to E. A. Barr (1954) discloses a plate construction for serving pie that incorporates an integral outwardly angled upstanding ledge that holds a back section of a pie-piece in place. U.S. Pat. No. 2,501,583 to H. A. Somers (1950) discloses a loose fitting scoop that fits within a refrigerator pan, allowing sections of the contents of the pan to be lifted out of the pan without damage. The upstanding ribs of these references are not high enough nor free standing and do not function as does Applicant's invention.

Finally, U.S. Pat. No. 4,413,745 to Stroud (1983) discloses a tray caddie having a plurality of open-topped compartments and adapted for securement to the rim of a round cocktail tray by a series of clips. Again the type of attachment the function and the teaching of this disclosure does not serve or suggest the claimed structure or purposes of Applicant's invention.

In summary, therefore, none of the above-mentioned prior art references would be suitable for shielding food carried upon a food service tray from the server's falling hair or the like. Moreover none of them are shaped or used in the manner of the present invention, nor are they suggestive of the novel features of this invention.

Additionally, it should be recognized that some of the noted prior art is not adaptable for use with food service trays and is not considered as properly relevant art. None of the disclosed references teach or suggest the several novel features of this invention which prevent contamination of food due to hair, hair follicles or the like during the transport of food from the kitchen to the patrons. This invention thus recognizes and provides a novel solution to a long-standing problem that is neither disclosed, nor solved by the prior art.

SUMMARY OF THE INVENTION

It is well known to use shields in conjunction with containers so as to prevent spillage of the contents. This invention, in contrast, uses a shield in combination with a food service tray to prevent hair follicles from falling upon the food and thereby contaminating the food to be served.

The shield of the invention is curved to fit adjacent to the outer perimeter of a standard food service tray, which tray may be rectangular, oval or circular in shape. The shield has an upstanding vertical ridge portion with an oversized base extending outwardly at a right angle from the lowest base point of the shield. The base is wide enough so that the shield will be free standing on the tray, and is also of sufficient size that dishes may be placed on the base, or the base and tray, thereby allowing the shield to be secured in place on the service tray for serving purposes.

The height and angle of the vertical upstanding shield is selected at an amount to separate any falling, or swirling hair of a server and the food on the tray.

OBJECTS OF THE INVENTION

It is an object of the present invention to employ a shield in combination with a food service tray in order to prevent food contamination due to swirling or falling hair from the server's head during transport of the tray.

It is another object of my invention to incorporate a base wide enough so that dishes may be placed upon it, allowing the shield to be held in place on the tray's surface.

It is still another object of this invention for the shield to be easily removable from the tray so that it can be easily cleaned.

It is yet another object of this invention for the shield to have an outwardly facing surface that is curved at the same radius and/or shape as a standard serving tray, allowing it to be held more firmly in place on the tray during serving and to more adequately shield the food to be served from any falling contamination, such as hair, hair follicles and the like.

It is yet another object of this invention to provide a vertical shield with an outer transitional planar surface where the shield joins the base, so that the hair shield is essentially mated to the tray rim and yet will allow the hair shield to also be free standing if the rim curvature of the tray and hair shield do not match.

BRIEF DESCRIPTION OF THE DRAWING

FIG. 2 includes FIG. 2A which is a side sectional view taken along the sectional lines through the tray at 2A—2A.

DESCRIPTION OF PREFERRED EXAMPLE EMBODIMENT AND BEST MODE OF THE INVENTION

Figure 1:
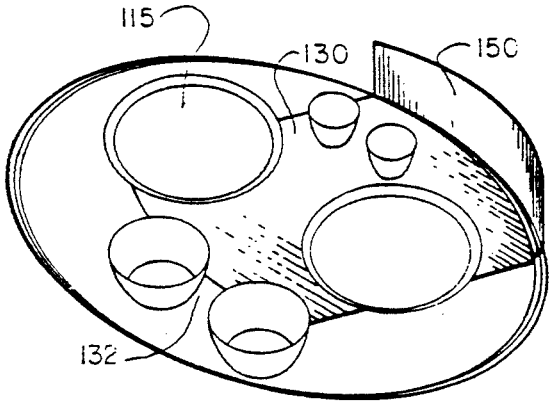
FIG. 1 is a perspective view of my hair protector invention in use on a service tray.

Turning now to the drawing of FIG. 1, the hair protector 125 is shown in FIG. 1 as having a base 130, and an upright shield 150.

Figure 2A:
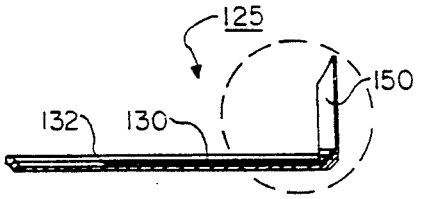
FIG. 2 is a top view of the hair protector shield of my invention as it would be used in combination with a standard oval food service tray.

Base 130 is large enough so that hair protector 125 will be freestanding in the upright position without lateral support as shown, for example, in the side sectional view of FIG. 2A.

Figure 2:
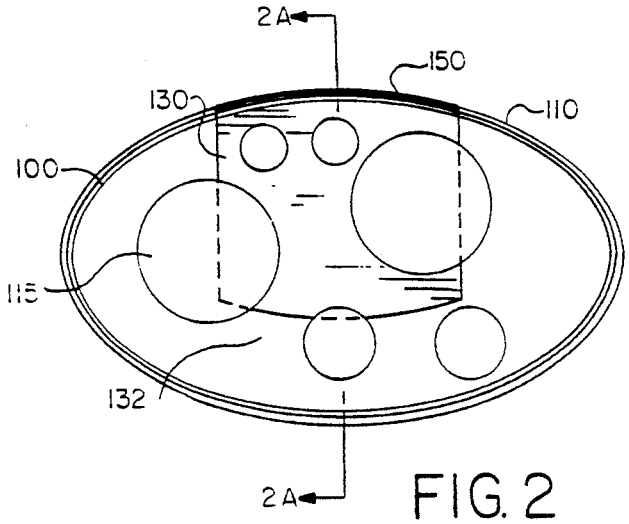

In FIGS. 1 and 2 base 130 extends away from the lowest edge of upright shield 150 inwardly on the tray 100, as shown, so that it will allow for placement of one or more dishes on the base 130. The user simply places some of the dishes on the base 130 and the weight of the food to be served provides added stability for hair protector 125 during transport of the tray 100.

Figure 3:
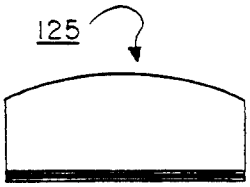
FIG. 3 is a front view of one embodiment of the hair protector shield of my invention.

As shown more clearly by the front view of FIG. 3, the upper edge of shield 125 is rounded, being higher in the center and sloping down toward the vertical sides. The height of the upright should be several inches at least in order to provide for more adequate protection from falling or swirling hair.

Upright shield 150, when viewed from above (as shown in FIG. 2) is curved at essentially the same proportion as the outer edge of the food service tray with which it is to be used. In these figures an oval tray is depicted, but a circular or oblong tray would likewise suffice so long as the shield conforms to the periphery of the appropriate tray.

As best shown by the side sectional view of FIG. 2A, base 130 and shield 150 are joined at a right angle at corner edge 135. Corner edge 135 has a transitional planar surface (shown in the enlarged view in FIG. 4) which is shaped to mate with the outer edge of the food service tray with which the hair protective shield is to be used. In this instance, depicted in FIG. 4, the standard service tray has a double stepped convex surface; and, thus, the mating surface on the corner edge 135 is a double stepped concave planar surface 235. Conforming the outer shape of the hair protective shield 125 to the tray rim's inner peripheral shape allows the hair protector 125 to mate with and set firmly at or near the outer edge of the food service tray 100.

Figure 4:
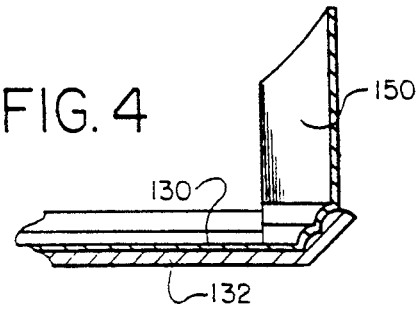
FIG. 4 is an enlarged view of a corner of the shield at the section circled in FIG. 2A.

FIG. 4 shows an enlarged side view cross section of both the tray rim 110 and the protector's corner edge 135 as it would appear for use with a standard serving tray 100. Tray 100 and rim 110 as shown in FIG. 4 includes a double convex (when viewed from the sectional line inwardly as cut through FIG. 2) planar surface 225. In order to have the shield 125 set firmly in place, conserve tray space and still not require any fastening of the protector 125 to the tray per se, the double concave surface 245 on the shield 125 matches the double convex surface 225 on tray rim 110.

Obviously the shape and design of standard food service trays have varied over time as has the shape of the tray rim. The shape of the transition piece from the flat tray surface to rim edge in some trays, such as cafeteria trays, are rounded or have a sloping inclined surface at about forty-five degrees. In these cases the outer transitional shape at the right angle corner edge of the protector 125, would also be at a matching curve or forty-five degree angle. Whether rounded, double convex or inclined, the concept for the shield 125 is to match the lower outside edge 135 to that of the tray rim 110.

FIG. 2 is a top view that more clearly shows the curvature of shield 150 and base 130. The most inward edge 132 of base 130 may be straight, curved outwardly (as shown in FIGS. 1 or 2) or curved inwardly and parallel to edge 135. In a similar manner, with reference to FIG. 3, the upper edge of shield 125 need not be rounded but may be straight and parallel with the flat base 150.

In use, the hair protective shield 125 is located conveniently on the serving tray surface 100 near the periphery of serving tray 100, FIG. 1, with which it is to be used. When the food is ready for service the waitress will first place the protector 125 on the tray 100 near its outer edge 110 with base 130 resting on the service tray's surface proper. The waitress will thereafter load the food to be served on the tray.

Certain dishes, such as plate 115, FIG. 1, may be set such that plate 115 rests on both the thin base 130 and the tray's upper surface. Curving the inward edge 132 of base 130 outwardly allows some smaller dishes to be fully set on the shield's base proper, with such dishes supportably resting either entirely on the shield base or resting on both the shield and the tray. These dishes provide additional stability for the hair protector 125.

Please note that when hair protector 125 is in use, the upright shield 150 is upstanding at the edge of the loaded tray 100 as is clearly shown in FIG. 1. The waitress simply orients the tray such that the upright shield portion 150 is placed between her head and the food when the food is to be carried to the table to be served. The upright shield 150 has smooth outer planar surfaces such that any hair or other contamination coming into contact with the upright shield 150 will drop onto the tray's surface. For example, hair protective shield 125 may be formed as an integral curved plastic piece that is both lightweight, durable and readily washable.

The invention has been shown with a curvature that conforms to a oval tray. However the invention is not so limited because circular and oblong trays also find common use. In any event, however, the invention's outward facing surface must conform to the outer periphery of the standard tray styles and have a smooth surface.

While may invention has been described with reference to a particular example of preferred embodiments, it is may intention to cover all modifications and equivalents within the scope of the following appended claims. It is therefore requested that the following claims be given a liberal interpretation which is within the spirit and scope of my contribution to this art.

What is claimed is:

1. In combination with a food service tray, a self-standing hair protector used to shield a user's hair and other contamination from falling upon food dishes to be served that are resting on said food service tray upon which the hair protector is placed between the server's head and food dishes being carried on the tray to patrons to be served, said hair protector comprising:

a thin flat base section for resting said hair protector as a free standing unit on a service tray, with said base section extending only inwardly from the periphery of the tray sufficiently that food dishes to be served may supportably rest on said base or both on said base and said tray; and an essentially vertical shield extending upwardly from the base section such that the shield is located on the tray between and separated from the food dishes to be served and shielding the user's head from the food dishes on said tray.

2. A hair protector in accordance with claim 1, wherein the serving tray is circular in shape, and said vertical shield is further characterized as comprising:

said vertical shield, when viewed from above, is shaped like a segment of the outer edge of a circle, and said shield has an outer and an inner facing planar surface, with said outward facing planar surface essentially conforming to the outer periphery of said circular tray, and the inner facing planar vertical surface being spaced away from food dishes to be served on said tray.

3. A hair protector in accordance with claim 2, wherein said tray has a raised upstanding rim at the periphery of said tray, with said rim having an inner geometrical shape, and said protector further comprises:

a transitional configuration for joining the vertical shield and base together, which transitional configuration has an outer geometrical shape that is selected to match the shape of the tray's upstanding rim such that the hair protector will rest as a separate free standing unit on said tray and yet will also snugly mate by said matching shape to the inner shape of the tray's upstanding rim.

4. A hair protector in accordance with claim 1 wherein the base portion that extends unto the tray surface, when viewed from above, is shaped like the arc of a circle.

5. A hair protector in accordance with claim 1 wherein the vertical shield and base are joined comprising:

means for integrally joining the shield with the base so that the integral pieces are rigid and at right angles to one another.

6. A method of shielding a user's hair, hair follicles and other contamination from falling upon food dishes to be served while such are resting on a food service tray, said method comprising the steps of:

locating a free standing hair protector having an upstanding vertical shield on said tray between the server's head and the food dishes being carried on the tray to patrons to be served;

providing a flat base section for said protector's vertical shield in order to allow said protector to rest in a free standing configuration on said service tray;

extending said base section inwardly from the periphery of the tray, such that the food dishes to be served may supportably rest on said base or on the tray and base;

extending a vertical shield upwardly from the base section for said protector such that the shield is above the dishes of food to be served, and may be spaced away from the food dishes; and locating said upwardly-extending shield on the tray between the food dishes to be served, as carried on the tray, and the user's head when the tray is being carried by the user to those to be served.

7. A method in accordance with claim 6, wherein the serving tray is circular in shape, and said method is further characterized by comprising the additional steps of:

shaping the outwardly facing surface of said shield, when viewed from above, like a segment of the outer edge of a circle; and selecting the radius for said circular shape such that said protector's outwardly facing shape essentially conforms with and matches the outer periphery of said circular tray.

8. A method in accordance with claim 8 wherein the tray has an upstanding rim with an given inner shape of said rim where said rim joins with the tray surface, and said vertical shield and base are further characterized by the method steps of:

integrally joining the shield with the base so that the integral pieces are rigid and are essentially at a right angle corner to one another; and shaping the outer transition of said corner in a shape such that the said corner matches the given shape of said rim.

9. A method of shielding a user's hair follicles and other contamination from falling upon dished food to be served while such food is resting on a standard food service tray having an upstanding rim with a given inner shape for said rim, said method comprising the steps of:

placing a free standing hair protector shield against the periphery of an upstanding rim on a standard serving tray, with said shield being located between the server's head and the dished food to be served during the time that the dished food is being carried on the tray to patrons to be served;

providing a flat base section on said protector for resting said hair protector in a free standing position against the rim on said service tray;

extending the entire surface of said flat base section inwardly and away from said shield and the periphery of the tray, such that food dishes to be served may rest both on said base and on the tray;

extending said shield upwardly from the base section for said protector such that the shield is spaced away from and has a height selected to be above the dishes of food to be served;

integrally joining the shield with the base so that the integral pieces are rigid and are at right angles to one another;

shaping said shield, when viewed from above, so that it matches a substantial segment of the outer edge of said standard service tray;

conforming the outward facing shape of said right angle to the inner shape of said upstanding rim such that the shield is held securely in place as a free standing piece at the periphery of said service tray; and locating said upwardly-extending shield on the tray between the food dishes to be served, as carried on the tray, and the user's head when the tray is being carried by the user.

* * * * *